US007258283B2

(12) United States Patent
Heinz et al.

(10) Patent No.: US 7,258,283 B2
(45) Date of Patent: Aug. 21, 2007

(54) FUEL INJECTOR WITH DIRECT NEEDLE CONTROL FOR AN INTERNAL COMBUSTION ENGINE

(75) Inventors: Rudolf Heinz, Renningen (DE); Stefan Schuerg, Ludwigsburg (DE); Wolfgang Stoecklein, Stuttgart (DE); Michael Mennicken, Wimsheim (DE); Holger Rapp, Ditzingen (DE); Thomas Kuegler, Korntal-Muenchingen (DE); Hans-Christoph Magel, Pfullingen (DE); Andreas Wengert, Auenwald (DE); Thomas Pauer, Freiberg (DE); Andreas Rau, Stuttgart (DE); Andreas Bartsch, Stuttgart (DE); Christian Kuhnert, Vaihingen Enz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 11/357,036

(22) Filed: Feb. 21, 2006

(65) Prior Publication Data

US 2006/0186221 A1 Aug. 24, 2006

(30) Foreign Application Priority Data

Feb. 18, 2005 (DE) ..... 10 2005 007 543

(51) Int. Cl.

| | |
|---|---|
| ***F02M 47/02*** | (2006.01) |
| ***F02M 41/16*** | (2006.01) |
| ***F02M 39/00*** | (2006.01) |
| ***F02M 47/00*** | (2006.01) |
| ***F02M 45/00*** | (2006.01) |
| ***F02M 61/10*** | (2006.01) |
| ***F02M 61/20*** | (2006.01) |

(52) U.S. Cl. ..... 239/88; 239/96; 239/102.2; 239/533.3; 239/533.4; 239/533.9

(58) Field of Classification Search ..... 239/88, 239/96, 102.2, 533.3, 533.4, 533.9, 89–91, 239/102.1, 533.2, 533.5, 533.8; 123/446, 123/447

See application file for complete search history.

(56) References Cited

U.S. PATENT DOCUMENTS 5,505,384 A * 4/1996 Camplin ..... 239/533.5

(Continued)

FOREIGN PATENT DOCUMENTS

DE 101 48 594 A1 4/2003

(Continued)

*Primary Examiner*—Joseph A. Kaufman
*Assistant Examiner*—Darren Gorman
(74) *Attorney, Agent, or Firm*—Ronald E. Greigg

(57) ABSTRACT

A fuel injector with a direct needle control for an internal combustion engine, having an actuator, a hydraulic booster, and a nozzle needle guided in a nozzle body and acting on a nozzle needle sealing seat. The hydraulic booster includes a booster piston connected to the actuator and a nozzle needle booster piston connected to the nozzle needle; a booster chamber in the form of an actuator coupler chamber is associated with a pressure surface of the actuator booster piston; and depending on the pressure in the actuator coupler chamber, the nozzle needle is lifted away from the nozzle needle sealing seat, thus initiating an injection. In addition to the actuator booster piston, a control element is provided that is able to execute a stroke motion, is hydraulically coupled to the actuator coupler chamber by means of a first control surface, and is associated with a control chamber by means of a second control surface. The actuator booster piston has a second pressure surface, which, as an additional control surface, is associated with the control chamber.

20 Claims, 3 Drawing Sheets

U.S. PATENT DOCUMENTS 6,520,423 B1 * 2/2003 Ricci-Ottati et al. ..... 239/89
6,776,354 B2 * 8/2004 Cooke ..... 239/102.2
2004/0123840 A1 * 7/2004 Matz et al. ..... 123/446
2006/0048751 A1 * 3/2006 Grimmiger et al. ..... 123/446
2006/0255184 A1 * 11/2006 Kanne et al. ..... 239/533.2
2007/0001032 A1 * 1/2007 Boecking ..... 239/533.3

FOREIGN PATENT DOCUMENTS

WO WO 2006/069865 A1 7/2006

* cited by examiner

FUEL INJECTOR WITH DIRECT NEEDLE CONTROL FOR AN INTERNAL COMBUSTION ENGINE

CROSS-REFERENCE TO RELATED APPLICATIONS

This application is based on German Patent Application 10 2005 007 543.6 filed Feb. 18, 2005, upon which priority is claimed.

BACKGROUND OF THE INVENTION

1. Field of the Invention

The invention relates to a fuel injector with direct needle control for an internal combustion engine.

2. Description of the Prior Art

Fuel injectors with a so-called direct needle control are known. Fuel injectors of this kind function properly without a control valve interposed between an electrically triggered actuator and a nozzle needle. The transmission of force between the actuator and the nozzle needle is implemented by means of a hydraulic coupler or hydraulic booster. For these actuators, it is particularly useful to use piezoelectric actuators, which have a direct or inverse triggering, depending on whether or not they are supplied with current in the closed state. With a direct triggering, the piezoelectric actuator is supplied with current in order to open the nozzle needle so that a longitudinal expansion of the piezoelectric actuator, through a pushing motion that is amplified by the booster, triggers an opening of the injection nozzles. In the closed state, the piezoelectric actuator has a shorter longitudinal span. With an inverse triggering, the piezoelectric actuator is supplied with current in the closed state of the nozzle needle so that when the piezoelectric actuator is in its longitudinally expanded state, it holds the nozzle needle closed. When the piezoelectric actuator is triggered to initiate the injection, the power to the piezoelectric actuator is switched off so that a pulling movement of the piezoelectric actuator causes a pressure drop in a control chamber of the hydraulic booster. This hydraulically boosts the stroke motion of the piezoelectric actuator in order to open the nozzle needle.

A fuel injector with direct needle control has already been proposed by patent application DE 10 2004 037 125.3. The fuel injector therein has an actuator booster piston and a nozzle needle booster piston; the actuator booster piston is associated with an actuator coupler chamber and the nozzle needle booster piston is associated with a nozzle needle coupler chamber. Between the actuator coupler chamber and the nozzle needle coupler chamber, a hydraulic throttle restriction is provided that has different flow cross sections for the flow of fuel into and out of the nozzle needle control chamber. A first sliding sleeve for delimiting the actuator coupler chamber is guided axially on the actuator booster piston and another sliding sleeve for delimiting the nozzle needle coupler chamber is guided axially on the nozzle needle booster piston. A compression spring prestresses the sliding sleeves so that they each press with an end surface against a respective sealing surface. The use of sliding sleeves makes it possible to axially decouple the actuator booster piston from the nozzle needle booster piston, permitting the booster pistons to be installed in axially offset positions.

OBJECT AND SUMMARY OF THE INVENTION

The object of the present invention is to create a fuel injector with two-stage boosting at different boosting ratios.

The object of the invention is attained with the defining characteristics that make it possible to create a compact fuel injector with direct needle control, which functions properly with a small number of moving parts in order to produce the required boosting ratios for a two-stage boosting.

Advantageous modifications of the invention are possible. A two-stage boosting of the actuator stroke with different boosting ratios can be achieved in a particularly suitable fashion if, in a first opening phase of the nozzle needle, the control element is situated in a starting position due to the pressures acting on its control surfaces and if, at the beginning of a second opening phase of the nozzle needle, the changing pressure ratios on the control surfaces of the control element cause the control element to lift away from its starting position so that the volume in the actuator coupler chamber increases, which alters the boosting ratio between the actuator booster piston and the nozzle needle booster piston. The control chamber functions as a pressure reservoir and/or energy storage means so that a pressure threshold is produced in the control chamber in order to initiate the second opening phase. It is particularly advantageous if the control element is provided in the form of a control sleeve that is guided so that it can slide axially on the actuator booster piston and whose first end surface, functioning as a first control surface, is hydraulically coupled to the actuator coupler chamber and whose second end surface, functioning as a second control surface, is associated with the control chamber. In a first opening phase of the nozzle needle, the first end surface is situated in its starting position. In a second opening phase of the nozzle needle, the first end surface lifts away from its starting position so that in the second opening phase of the nozzle needle, the actuator coupler chamber acts on an effective surface comprised of the pressure surface of the booster piston and the first end surface. The actuator booster piston is suitably embodied in the form of a stepped piston having both the first pressure surface and the second pressure surface. Moreover, in a suitable embodiment form of the fuel injector, the coupler chamber associated with the actuator pressure booster piston is hydraulically connected to a nozzle needle coupler chamber associated with the nozzle needle booster piston. A sliding sleeve is guided on the actuator booster piston in order to embody the control chamber and coupler chamber associated with the actuator booster piston.

BRIEF DESCRIPTION OF THE DRAWINGS

The invention will be better understood and further objects and advantages thereof will become more apparent from the ensuing detailed description of preferred embodiments, taken in conjunction with the drawings, in which.

DESCRIPTION OF THE PREFERRED EMBODIMENTS

Figure 1:
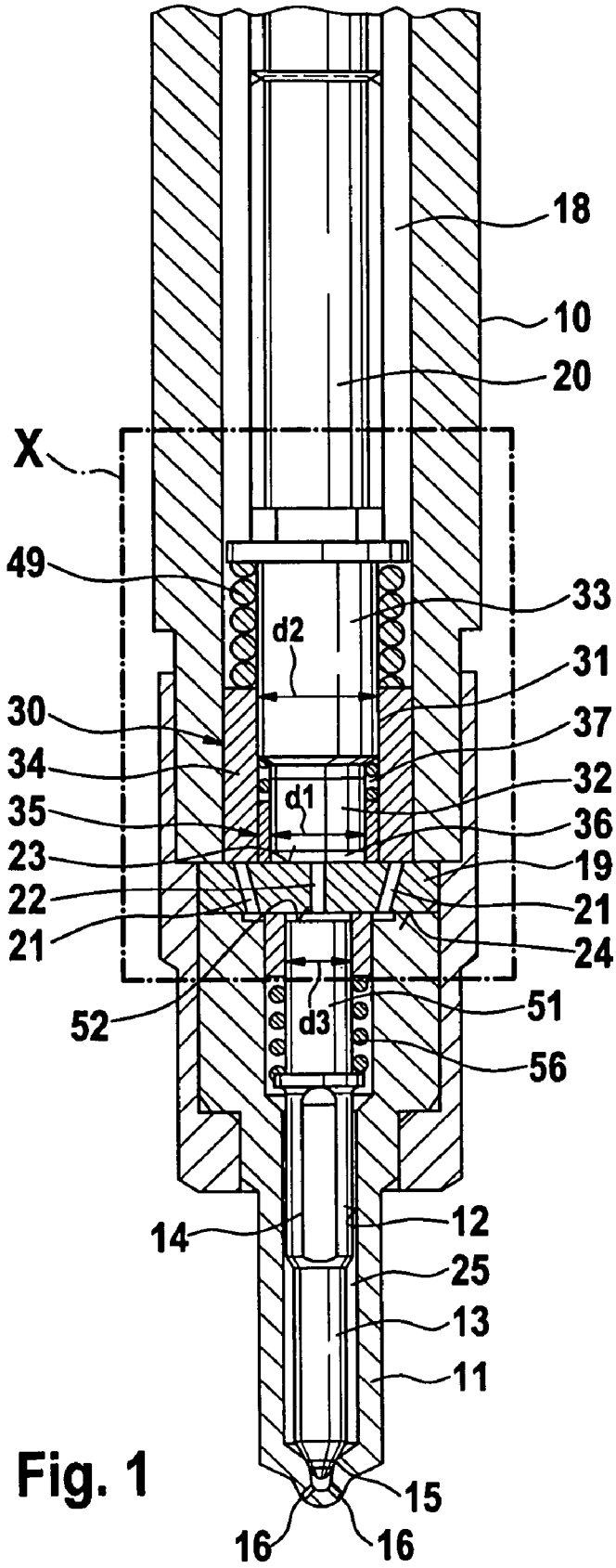
FIG. 1 shows a section through a part of a fuel injector according to the invention.

The fuel injector shown in FIG. 1 has an injector housing 10 with a nozzle body 11 whose lower end protrudes into a combustion chamber of an internal combustion engine. The nozzle body 11 is provided with a nozzle needle guide 12 whose guide section 14 guides a nozzle needle 13 in an axially movable fashion. Between the tip of the nozzle needle 13 and the nozzle body 11, a sealing seat 15 is provided, downstream of which injection nozzles 16 in the nozzle body 11 lead into the combustion chamber. In an upper region, the injector housing 10 has a chamber 18 that is connected to a fuel inlet, not shown, connected to a high-pressure system, e.g. a common rail system of a diesel injection apparatus. An intermediate body 19 with an actuator surface 23 and a nozzle needle surface 24 is provided between the injector housing 10 and nozzle body 11 and is equipped with connecting bores 21 and a hydraulic connection 22 that functions as a throttle. The fuel that is introduced into the chamber 18 via the fuel inlet travels via the connecting bores 21 into a high-pressure chamber 25 associated with the nozzle needle 13.

Figure 2:
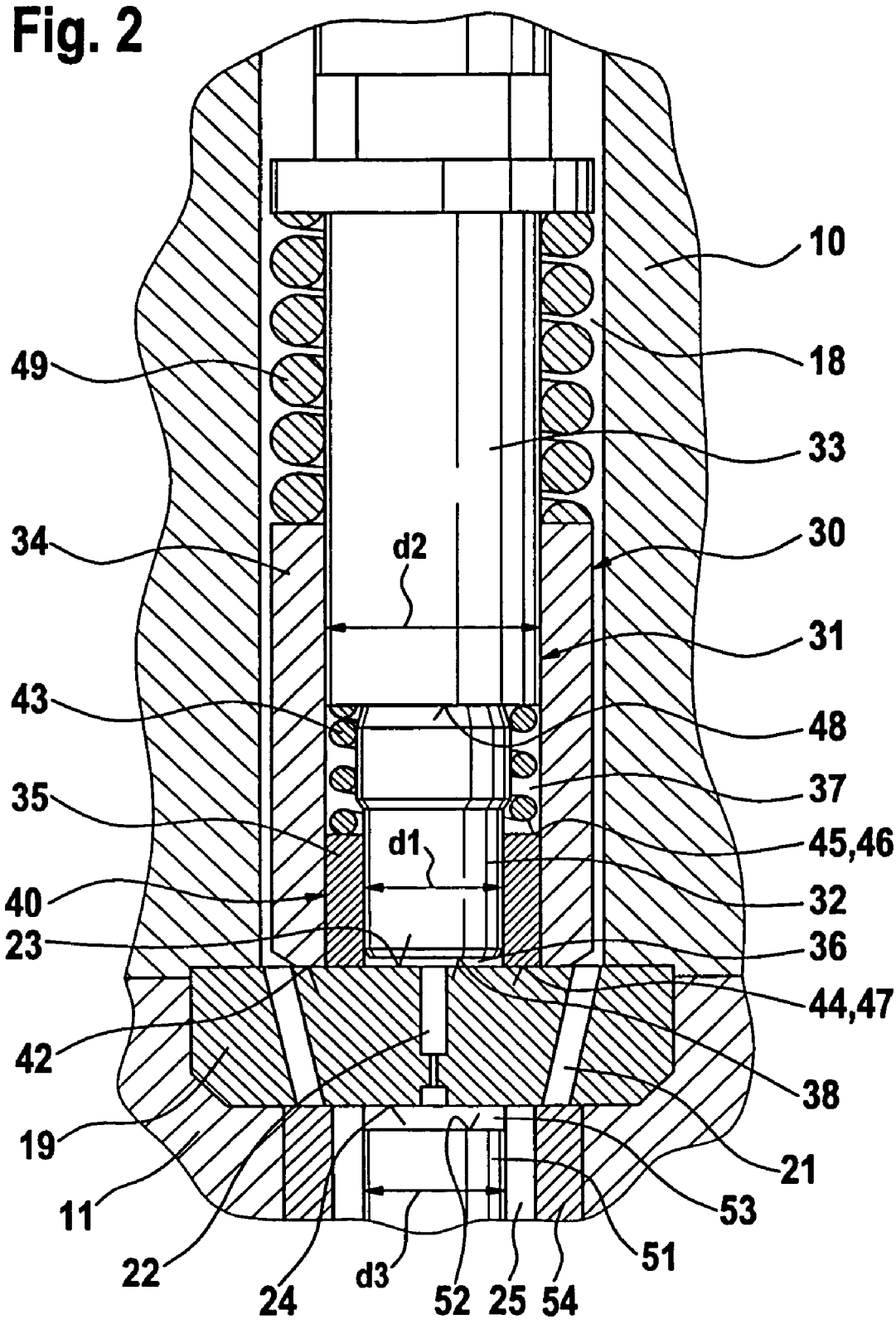
FIG. 2 shows an enlarged detail X according to FIG. 1.

The chamber 18 contains a piezoelectric actuator 20 that acts on a hydraulic booster 30. The hydraulic booster 30 has an actuator booster piston 31 drive-coupled to the piezoelectric actuator 20 and likewise contained in the chamber 18. The actuator booster piston 31 is embodied in the form of a stepped piston that has a first piston section 32 with a diameter d1 and a second piston section 33 with a diameter d2, where d2>d1. The hydraulic booster 30 also has a sliding sleeve 34 guided on the second piston section 33, a control sleeve 35 guided axially between the sliding sleeve 34 and the first piston section 32, an actuator coupler chamber 36, and a control chamber 37. According to FIG. 2, the first piston section 32 of the actuator booster piston 31 has a coupler chamber pressure surface 38 oriented toward the actuator coupler chamber 36. Because of the diametrical relationship d1<d2 between the first piston section 32 and the second piston section 33, the second piston section 33 has an annular surface with a second pressure surface 48 that functions as an additional control surface facing into the control chamber 37.

Figure 3:
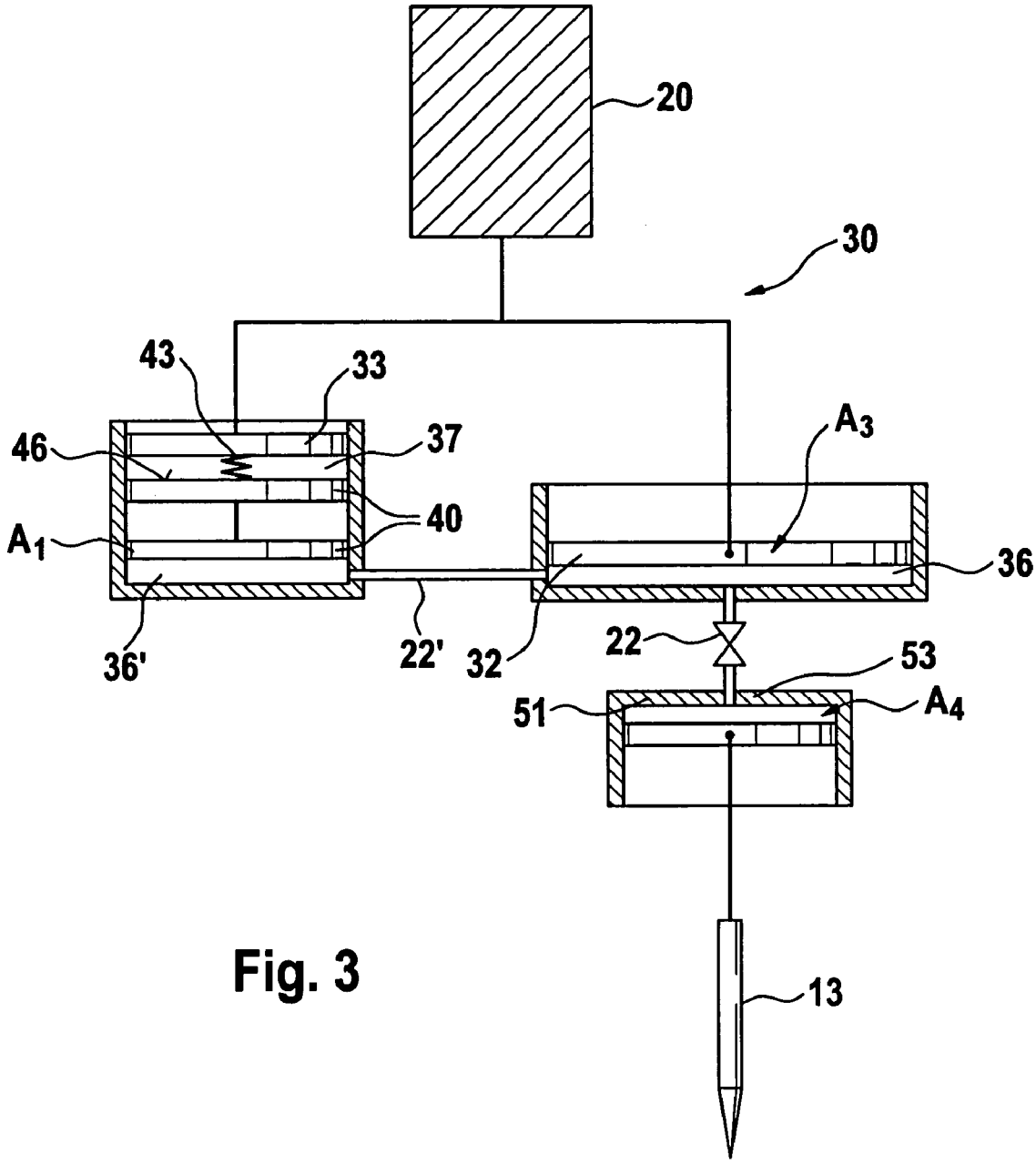
FIG. 3 is an equivalent hydraulic circuit diagram depicting the function of the fuel injector according to the invention.

The control sleeve 35 functions as a control element 40 that will be described below generally in connection with FIG. 3. The control sleeve 35 has a first end surface 44 and a second end surface 45 and is prestressed by a compression spring 43 supported on the actuator booster piston 31. The compression spring 43 assures that the control sleeve 35 is held in a starting position until the second opening phase of the nozzle needle 13 begins. In the starting position, the first end surface 44 of the control sleeve 35 is pressed against the actuator surface 23 of the intermediate body 19 so that in this position, the control sleeve 35 delimits the actuator coupler chamber 36. The first end surface 44 constitutes a first control surface 47 hydraulically coupled to the actuator coupler chamber 36. The second end surface 45 situated at the opposite end of the control sleeve 35 from the end surface 44, faces into the control chamber 37 and constitutes a second control surface 46 for the control sleeve 35 in relation to the control chamber 37.

Another compression spring 49 also supported on the actuator booster piston 31 prestresses the sliding sleeve 34. It pushes against the sliding sleeve 34 in FIG. 2 so that an end surface 42 is pressed against the actuator surface 23 of the intermediate body 19, constituting a sealed surface against the surface 23.

The hydraulic booster 30 also has a nozzle needle booster piston 51 with a diameter d3, which is connected to the nozzle needle 13 and has a nozzle needle pressure surface 52 facing into a nozzle needle coupler chamber 53. The nozzle needle booster piston 51 has an additional sliding sleeve 54 axially guided on it, which a closing spring 56 presses against the nozzle needle surface 24 of the intermediate body 19 so that this additional sliding sleeve 54 delimits the nozzle needle coupler chamber 53. The hydraulic connection 22 connects the nozzle needle coupler chamber 53 to the actuator coupler chamber 36. The hydraulic connection 22 can function as a throttle. The use of sliding sleeves 34 and 54 on the booster pistons 31 and 51 axially decouples the actuator booster piston 31 from the nozzle needle booster piston 51.

When the injection nozzles 16 are closed, the sealing seat 15 of the nozzle needle 13 is closed. The system pressure supplied to the chamber 18 and pressure chamber 25 via the fuel inlet is equally present in all of the pressure chambers. The sliding sleeves 34, 54 and the control sleeve 35 are provided with leakage gaps so that the system pressure is present in the actuator coupler chamber 36, the control chamber 37, and the nozzle needle coupler chamber 53. In this state, the hydraulic booster 30 is pressure-balanced and the piezoelectric actuator 20 is supplied with a voltage that brings the piezoelectric actuator 20 into its loaded state in the vertical direction. The system pressure present in the nozzle needle coupler chamber 53 acts on the nozzle needle booster piston 51 in the closing direction. As a result, in this state of the piezoelectric actuator 20, the sealing seat 15 of the nozzle needle 13 is closed. The nozzle needle is also acted on by the closing spring 56, which keeps the nozzle needle 13 closed in the no-current state.

If the voltage in the piezoelectric actuator 20 is reduced or if the piezoelectric actuator 20 is relaxed by means of a current, then this likewise reduces the length of the piezoelectric actuator 20 in the vertical direction. The piezoelectric actuator 20 is consequently an inversely operated actuator. The actuator booster piston 31, which the compression spring 49 prestresses toward the piezoelectric actuator 20, thus likewise moves in the vertical direction due to the reduced vertical length of the piezoelectric actuator 20. Due to this outwardly directed, pulling movement of the actuator booster piston 31, the pressure surface 38 of the first piston section 32 enlarges the volume in the actuator coupler chamber 36, which results in a pressure reduction therein, which determines an opening pressure for a first opening phase for the opening of the nozzle needle 13. The hydraulic connection 22 transmits the opening pressure into the nozzle needle coupler chamber 53 so that the opening pressure likewise acts on the nozzle needle pressure surface 52. This establishes a first boosting ratio for the opening of the nozzle needle 13, which exists due to the ratio of the surface areas of the pressure surfaces 38 and 52; the boosting ratio of the first opening phase is determined by the surface area ratio $d1^2/d3^2$. At the same time as the pulling movement of the actuator booster piston 31, the second piston section 33 and the upward motion of the second pressure surface 48 facing into the control chamber 37 increase the volume in the control chamber 37, thus decreasing the pressure in the control chamber 37 as well. The control chamber 37 thus functions as a pressure reservoir and an energy storage means in the form of hydraulic spring. As the stroke of the nozzle needle 51 increases, the pressure in the nozzle needle coupler chamber 53 rises again due to the pressure migration at the sealing seat 15 of the nozzle needle 13, while the pressure in the control chamber 37 continues to fall. This leads to conditions that permit the control sleeve 35 to lift away from the actuator surface 23, thus freeing the first end surface 44 of the control sleeve 35, which then functions as a first control surface 47 acting on the actuator coupler chamber 36. The actuator coupler chamber 36 is now radially delimited by the sliding sleeve 34. The actuator coupler chamber 36 consequently acts on an effective pressure surface area composed of the actuator pressure surface 38 of the first piston section 32 and the first end surface 44 of the control sleeve 35. Because the inner diameter of the sliding sleeve 34 is guided against the diameter d2 of the second piston section 33 and the control sleeve 35 is situated between the sliding sleeve 34 and the piston section 32, where the outer diameter of the control sleeve 35 is guided against the inner diameter of the sliding sleeve 34, the combined effective pressure surface area is determined by the outer diameter of the control sleeve 35, which corresponds to the diameter d2. The combined effective pressure surface area produces a jump in the boosting, which acts on the nozzle needle pressure surface 52 of the nozzle needle booster piston 51 in the form of a second boosting ratio. As a result, the stroke of the piezoelectric actuator 20 is transmitted to the nozzle needle 13 with a more powerful boosting that results from the surface area ratio of the combined effective pressure surface areas to the pressure surface 52; the surface area ratio $d2^2/d3^2$ determines the second boosting ratio. As a result, the nozzle needle 13 is moved at a faster speed and for a greater stroke distance.

The boosting ratios for the first opening phase and second opening phase of the nozzle needle 13 will now be explained in greater detail in conjunction with the equivalent hydraulic circuit diagram shown in FIG. 3. If, due to the inverse triggering, the piezoelectric actuator 20 imparts a pulling movement to the first piston section 32 with the surface area A3, and with the second piston section 33 on the control chamber 37, then a pressure reduction in the actuator coupler chamber 36—which depends on the surface area A3—occurs, which the connection 22 transmits to the nozzle needle coupler chamber 53. A pressure reduction in the coupler chamber 36 initiates the first opening phase through a first lifting of the nozzle needle 13 away from the sealing seat 15. The control element 40, which faces into the control chamber 37 with the control surface 46 and is represented in the form of a piston, initially remains in a starting position due to the pressure prevailing in the control chamber 37. The compression spring 43 plays only a supporting role in this. As the pulling stroke of the piezoelectric actuator 20 increases, the second piston section 33 reduces the pressure in the control chamber 37 further until it falls below the pressure in the chamber 36'. When this value is reached, the control element 40 with the surface area A1, which corresponds to the first control surface 47, begins to move. The pulling motion of the surface area A1 creates additional volume in the chamber 36', which also affects the actuator coupler chamber 36 via the connection 22'. The connection 22 transmits the additional volume to the nozzle needle coupler chamber 53 so that the surface area A4 of the nozzle needle booster piston 51 is now opposed by the sum of the surface areas A1 and A3 as a boosting ratio for the execution of the second opening phase. The boosting ratio of the second opening phase (A1+A3) to A4 is consequently greater than the boosting ratio of the first opening phase, which is determined by the ratio of A3 to A4. The increased boosting ratio of the second opening phase achieves a faster opening speed with a greater stroke travel when the nozzle needle 13 opens.

Supplying the piezoelectric actuator 20 with current causes the piezoelectric actuator 20 to start elongating again, which is transmitted by the actuator booster piston 31 to the control chamber 37 and the actuator coupler chamber 36. Next, assisted by the compression spring 43, the end surface 44 of the control sleeve 35 is pressed against the surface 23, thus producing the actuator coupler chamber 36 beneath the actuator pressure surface 38. At the same time, the pressure surface 38 of the first piston section 32 increases the pressure in the actuator coupler chamber 36, which the hydraulic connection 22 transmits to the nozzle needle coupler chamber 53; due to the pressure increase in the nozzle needle coupler chamber 53, the nozzle needle booster piston 51 presses the nozzle needle 13 against the sealing seat 15, thus disconnecting the injection nozzles 16 from the pressure chamber 25. At the same time, a pressure-balanced state arises once more in the pressure chambers of the hydraulic booster 30.

The foregoing relates to preferred exemplary embodiments of the invention, it being understood that other variants and embodiments thereof are possible within the spirit and scope of the invention, the latter being defined by the appended claims.

We claim:

1. A fuel injector for an internal combustion engine, the injector comprising a nozzle needle that is guided in a nozzle body and acts on a nozzle needle sealing seat, an actuator, a hydraulic booster equipped with an actuator booster piston connected to the actuator and a nozzle needle booster piston connected to the nozzle needle;

the actuator booster piston and the nozzle needle booster piston act on at least one booster chamber;

said at least one booster chamber including an actuator coupler chamber associated with a pressure surface of the actuator booster piston; the nozzle needle being lifted away from the nozzle needle sealing seat, depending on the pressure in the actuator coupler chamber, thus initiating the injection of highly pressurized fuel, in addition to the actuator booster piston, a control element is provided that is able to execute a stroke motion, the control element being hydraulically coupled to the actuator coupler chamber by means of a first control surface, and being associated with a control chamber by means of a second control surface; and a second actuator surface on the actuator booster piston which, as an additional control surface, is associated with the control chamber.

2. The fuel injector according to claim 1, wherein in a first opening phase of the nozzle needle, the control element is situated in a starting position and in a second opening phase of the nozzle needle, the control element lifts away from the starting position, thus enlarging the volume in the actuator coupler chamber.

3. The fuel injector according to claim 1, wherein the control element is guided on the actuator booster piston in such a way that it can execute a stroke motion.

4. The fuel injector according to claim 2, wherein the control element is guided on the actuator booster piston in such a way that it can execute a stroke motion.

5. The fuel injector according to claim 1, wherein the control element comprises a control sleeve that is guided axially on said actuator booster piston and having a first end surface, functioning as said first control surface, which is hydraulically coupled to the actuator coupler chamber and a second end surface, functioning as said second control surface, which is associated with the control chamber.

6. The fuel injector according to claim 2, wherein the control element comprises a control sleeve that is guided axially on said actuator booster piston and having a first end surface, functioning as said first control surface, which is hydraulically coupled to the actuator coupler chamber and a second end surface, functioning as said second control surface, which is associated with the control chamber.

7. The fuel injector according to claim 3, wherein the control element comprises a control sleeve that is guided axially on said actuator booster piston and having a first end surface, functioning as said first control surface, which is hydraulically coupled to the actuator coupler chamber and a second end surface, functioning as said second control surface, which is associated with the control chamber.

8. The fuel injector according to claim 5, wherein, in a first opening phase of the nozzle needle, the first end surface is situated in a starting position and in a second opening phase of the nozzle needle, the first end surface lifts away from the starting position so that in the second opening phase of the nozzle needle, the actuator coupler chamber acts on an effective surface area that is composed of the pressure surface of the booster piston and the first end surface.

9. The fuel injector according to claim 6, wherein, in said first opening phase of the nozzle needle, the first end surface is situated in a starting position and in said second opening phase of the nozzle needle, the first end surface lifts away from the starting position so that in the second opening phase of the nozzle needle, the actuator coupler chamber acts on an effective surface area that is composed of the pressure surface of the booster piston and the first end surface.

10. The fuel injector according to claim 7, wherein, in a first opening phase of the nozzle needle, the first end surface is situated in a starting position and in a second opening phase of the nozzle needle, the first end surface lifts away from the starting position so that in the second opening phase of the nozzle needle, the actuator coupler chamber acts on an effective surface area that is composed of the pressure surface of the booster piston and the first end surface.

11. The fuel injector according to claim 8, further comprising a compression spring which brings the control sleeve into a starting position before the beginning of the first opening phase of the nozzle needle.

12. The fuel injector according to claim 9, further comprising a compression spring which brings the control sleeve into a starting position before the beginning of the first opening phase of the nozzle needle.

13. The fuel injector according to claim 10, further comprising a compression spring which brings the control sleeve into a starting position before the beginning of the first opening phase of the nozzle needle.

14. The fuel injector according to claim 1, wherein the actuator booster piston is a stepped piston with a first piston section and a second piston section; and wherein the pressure surface of the actuator booster piston associated with the actuator coupler chamber is formed on said first piston section and said second actuator surface on the actuator booster piston associated with the control chamber is formed on said second piston section.

15. The fuel injector according to claim 5, wherein the actuator booster piston is a stepped piston with a first piston section and a second piston section; and wherein the pressure surface of the actuator booster piston associated with the actuator coupler chamber is formed on said first piston section and said second actuator surface on the actuator booster piston associated with the control chamber is formed on said second piston section.

16. The fuel injector according to claim 8, wherein the actuator booster piston is a stepped piston with a first piston section and a second piston section; and wherein the pressure surface of the actuator booster piston associated with the actuator coupler chamber is formed on said first piston section and said second actuator surface on the actuator booster piston associated with the control chamber is formed on said second piston section and a second pressure surface of the second piston section is associated with the control chamber.

17. The fuel injector according to claim 14, wherein the control element is guided axially on the first piston section.

18. The fuel injector according to claim 14, further comprising a sliding sleeve guided axially on the second piston section and the control element is axially guided between the first piston section and the sliding sleeve.

19. The fuel injector according to claim 17, further comprising a sliding sleeve guided adally on the second piston section and the control element is axially guided between the first piston section and the sliding sleeve.

20. The fuel injector according to claim 1, further comprising a nozzle needle coupler chamber that acts on a nozzle needle pressure surface of the nozzle needle booster piston, and a hydraulic connection connecting the actuator coupler chamber and the nozzle needle coupler chamber.

* * * * *